United States Patent [19]

Krasnoff et al.

[11] 4,450,920

[45] May 29, 1984

[54] HYDRAULIC RECIPROCATING MACHINES

[75] Inventors: Eugene L. Krasnoff, Princeton; Herman Lindeboom, Ringoes, both of N.J.

[73] Assignee: Ingersoll-Rand Company, Woodcliff Lake, N.J.

[21] Appl. No.: 327,246

[22] Filed: Dec. 3, 1981

[30] Foreign Application Priority Data

Jul. 13, 1981 [ZA] South Africa ..... 81/4749

[51] Int. Cl.[3] ..... E21C 7/08; B25D 17/16

[52] U.S. Cl. ..... 173/80; 91/224; 173/136

[58] Field of Search ..... 173/134, 136, 80; 91/224, 234, 49

[56] References Cited

U.S. PATENT DOCUMENTS

| | | | |
|---|---|---|---|
| 1,096,886 | 5/1914 | Bayles | 91/224 |
| 3,101,796 | 8/1963 | Stall et al. | 91/224 X |
| 3,130,799 | 4/1964 | Williams | 91/49 X |
| 3,236,157 | 2/1966 | Lovell et al. | 91/224 |
| 3,480,088 | 11/1969 | Ghelfi | 173/136 X |
| 3,524,385 | 8/1970 | Ottestad | 91/224 |

*Primary Examiner*—Frank T. Yost

*Attorney, Agent, or Firm*—Walter C. Vliet

[57] ABSTRACT

A reciprocating machine comprising a cylinder with a drive chamber and a return chamber; a piston arranged to move to and fro in the cylinder with a first piston area exposed to the drive chamber and being smaller than a second piston area exposed to the return chamber; a permanently open inlet for fluid to the drive chamber; a restricted outlet for fluid from the return chamber; a bore extending through the piston from a port in its first area to its second area; a first valve with a head adapted to seat on the port and a stem guided in the end wall of the drive chamber; and means for limiting the extent of travel of the first valve with the piston so that the first valve can travel with the piston only part of the way from the drive chamber toward the return chamber.

6 Claims, 3 Drawing Figures

HYDRAULIC RECIPROCATING MACHINES

BACKGROUND OF THE INVENTION

This invention relates to hydraulic reciprocating machines in which a piston is caused to move to and fro under the action of a hydraulic fluid under pressure.

Known machines of this kind either work on differential piston areas and have an external valve which controls the admission of fluid to and from a space in which one piston area works while the other area is at a more or less constant pressure or rely on an external valve for pressurizing and depressurizing two piston faces alternately.

An object of the invention is to provide a reciprocating motor which does not rely on an external valve. A further object of the invention is to provide a machine which can be used in rock drilling applications and which can be driven off water mains pressure and also at the same time utilizes the driving water for flushing purposes.

SUMMARY OF THE INVENTION

According to the invention a reciprocating machine comprises:

a cylinder with a drive chamber and a return chamber;

a piston arranged to move to and fro in the cylinder with a first piston area exposed to the drive chamber and being smaller than a second piston area exposed to the return chamber;

a permanently open inlet for fluid to the drive chamber;

a restricted outlet for fluid from the return chamber;

a bore extending through the piston from a port in its first area to its second area;

a first valve with a head adapted to seat on the port and a stem guided in the end wall of the drive chamber; and means for limiting the extent of travel of the first valve with the piston so that the first valve can travel with the piston only part of the way from the drive chamber towards the return chamber.

The restricted outlet may be provided through an anvil or a drilling tool chuck in the return chamber end and adapted to be struck by the piston, the limiting means arresting the movement of the valve before impact of the piston.

DESCRIPTION OF A PREFERRED EMBODIMENT

Figure 1:
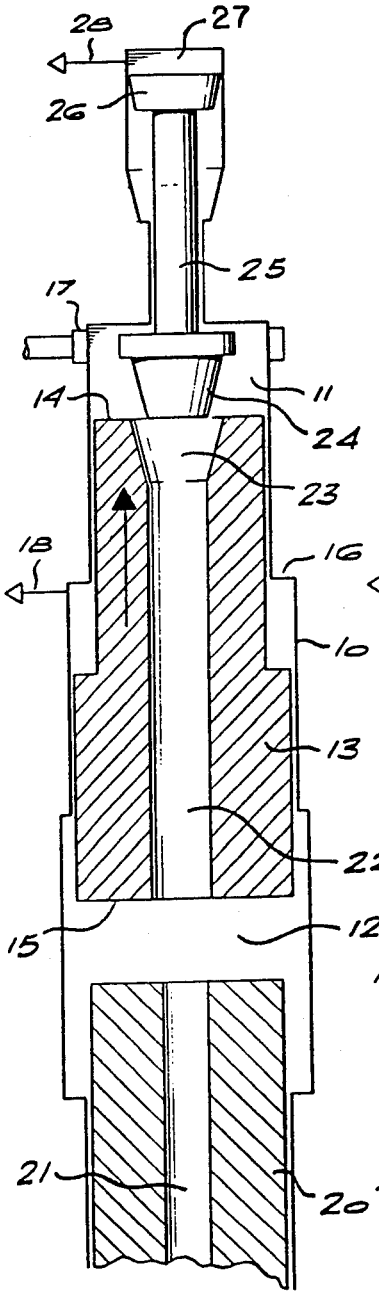
FIG. 1 is a secion, largely diagrammatic, through a machine according to the invention.
Figure 2:
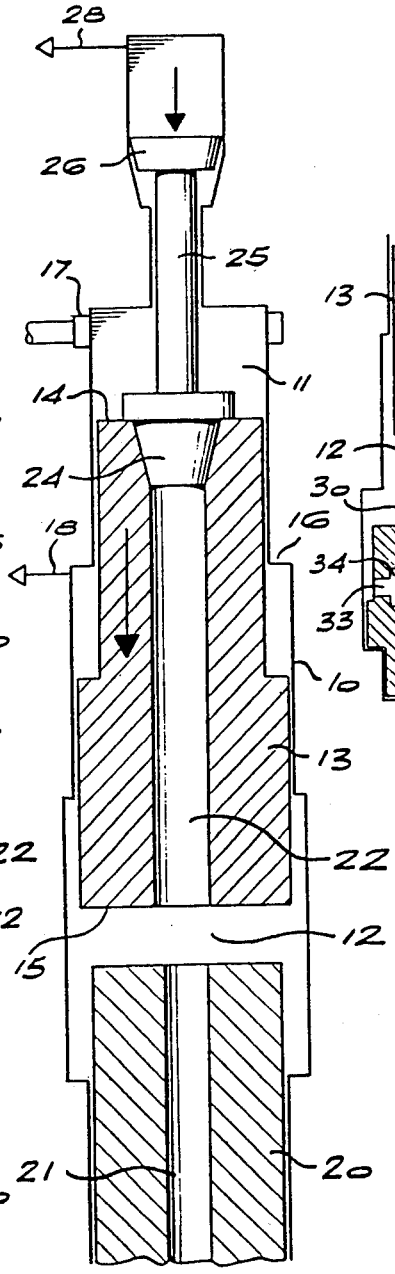
FIG. 2 is a view similar to FIG. 1 with the parts in a different position.

FIGS. 1 and 2 show the reciprocating part of a rock drill adapted to be worked off water mains in a mine. As shown the machine has a cylinder 10 formed with a drive chamber 11 and a return chamber 12. A piston 13 is formed with a narrow end 14 working in the drive chamber 11 and a wide end 15 working in the return chamber 12. Between the chamber 11 and 12 there is a shoulder 16.

The drive chamber 11 is provided with an inlet 17 which is use is always under supply pressure. At the shoulder 16 there is a vent 18.

In the return chamber 12 there is an anvil 20 adapted to strike a rock drilling tool (not shown). The anvil 20 is formed with an axial bore 21 leading to a similar bore in the tool. The anvil 20 could be replaced by the tool itself in an appropriate case.

In the piston 13 there is an axial bore 22 leading from a tapered port 23.

Guided in the end wall of the chamber 11 there is a poppet valve formed with a frustoconical head 24 and a stem 25 carrying a plunger 26. The plunger 26 moves in a space 27 with a vent 28.

FIG. 1 shows the piston 13 on its return stroke. Due to the differential areas of the ends 14 and 15 the piston 13 is caused to move up. The valve 24 is being held in the position shown for the same reason. However as the piston moves up, the flow area of the port 23 decreases and the pressure under the head 24 reduces so that the head 24 moves down to seat in the port 23. The head 24 is now held in place by the supply pressure.

Due to the pressure in the chamber 11 and the decrease in pressure in the chamber 12 the piston is now forced to move down (FIG. 2). As the piston moves down it may cause the pressure in the chamber 12 to rise again. Due to such an increase in pressure or due to the plunger 26 dashpotting in the space 27, the head 24 separates from the piston 13 while the latter is still moving down. Thus the piston 13 hits the anvil 20 after the valve has been forced up again due to its differential areas.

At this point the pressure in the chamber 12 is now at a maximum and the same as in the chamber 11 so that the piston 13 moves up to repeat the cycle.

By a suitable choice of the diameter of the bore 21 it can be arranged that the pressure in the chamber 12 is at its highest just before impact so that the motive water flushes chips and crushed rock away before each blow.

Figure 3:
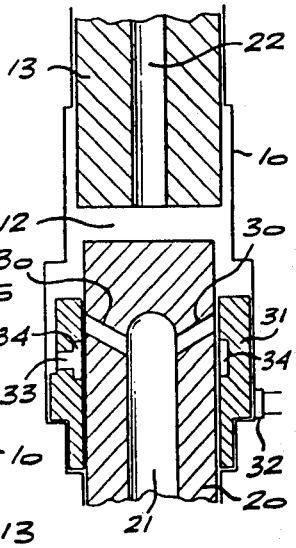
FIG. 3 is a fragmentary view of a modification of the invention.

During the return stroke the port 23 is fully open and the supply communicates directly with the water flushing hole. This leads to very high through flow rates and may be undesirable and wasteful. FIG. 3 shows a way of limiting the flow. In this modification the bore 21 is closed at the top and transverse holes 30 communicate with it. The anvil 20 is surrounded by a sleeve valve 31 acted on by the supply pressure in an annular cavity 32. A port 33 leads to an annular recess around the anvil 20. As shown the recess 34 is out of register with the holes 30 and the water can only pass down the bore 21 through leakage past the various parts. As long as the chamber 12 is at supply pressure, this situation prevails.

If now the valve 24 closes in the port 23, the pressure in the chamber 12 drops and as a result of the pressure in the annulus 32, the valve 31 moves up for the recess 34 to register with the holes 30. Full flow through the bore 21 ensues until the chamber 12 is once more at supply pressure.

Note that the upward movement of the sleeve valve 31 helps to prevent cavitation when the valve 24 is closed.

In the embodiments described above water is the motive fluid. If the motive fluid is another hydraulic fluid, the same principles can be employed by providing a restricted outlet from the chamber 12 to tank and connecting the vents 18 and 28 to tank.

We claim:

1. A hydraulic reciprocating machine comprising:

a cylinder with a drive chamber and a return chamber;

a piston arranged to move to and fro in the cylinder with a first piston area exposed to the drive chamber and being smaller than a second piston area exposed to the return chamber;

a permanently open inlet for fluid to the drive chamber;

a restricted outlet for fluid from the return chamber;

a bore extending through the piston from a port in its first area to its second area;

a first valve with a head adapted to seat on the port and a stem guided in the end wall of the drive chamber;

means for limiting the extent of travel of the first valve with the piston so that the first valve travels with the piston a determined portion of the way from the drive chamber towards the return chamber; and a shoulder between the drive and return chambers and a vent in the return chamber adjacent the shoulder.

2. A machine according to claim 1 in which the restricted outlet is through an anvil or drilling tool chucked in the return chamber end and adapted to be struck by the piston, the limiting means arresting the movement of the valve before impact of the piston.

3. A machine according to claim 2 including a second valve controlling the restricted outlet in response to fluid pressure in the return chamber so that the outlet is limited when that pressure is high and is fully open when the first valve closes and the pressure in the return chamber gets lower.

4. A machine according to claim 3 in which the anvil or drilling tool has lateral holes leading to an axial bore, the holes are surrounded by a sleeve forming said second valve with differential areas exposed to the return chamber and the hydraulic supply pressure.

5. A machine according to claim 1 including a plunger on the stem acting in a dashpot in the end wall of the drive chamber, entry of the plunger into the dashpot limiting the travel of the first valve.

6. A machine according to claim 5 in which the dashpot is at one end of a vented space.

* * * * *